US006182471B1

(12) United States Patent
Meagher

(10) Patent No.: US 6,182,471 B1
(45) Date of Patent: Feb. 6, 2001

(54) CRYOGENIC RECTIFICATION SYSTEM FOR PRODUCING OXYGEN PRODUCT AT A NON-CONSTANT RATE

(75) Inventor: James Patrick Meagher, Buffalo, NY (US)

(73) Assignee: Praxair Technology, Inc., Danbury, CT (US)

( * ) Notice: Under 35 U.S.C. 154(b), the term of this patent shall be extended for 0 days.

(21) Appl. No.: 09/340,032

(22) Filed: Jun. 28, 1999

(51) Int. Cl.[7] ..... F25J 3/02
(52) U.S. Cl. ..... 62/646; 62/647
(58) Field of Search ..... 62/646, 643, 647

(56) References Cited

U.S. PATENT DOCUMENTS 5,084,081 * 1/1992 Rohde ..... 62/654
5,224,336 7/1993 Agrawal et al. ..... 62/37
5,265,429 * 11/1993 Dray ..... 62/643
5,406,800 4/1995 Bonaquist ..... 62/21
5,408,831 * 4/1995 Guillard et al. ..... 62/647
5,437,160 8/1995 Darredeau et al. ..... 62/24
5,505,052 * 4/1996 Ekins et al. ..... 62/643
5,582,032 * 12/1996 Shelton et al. ..... 62/643
5,592,834 1/1997 Darredeau et al. ..... 62/656
5,979,182 * 11/1999 Goto et al. ..... 62/643
6,062,044 * 5/2000 Bernard et al. ..... 62/654

* cited by examiner

*Primary Examiner*—William Doerrler
(74) *Attorney, Agent, or Firm*—Stanley Ktorides

(57) ABSTRACT

A cryogenic air separation system wherein product oxygen may be produced effectively at a higher production rate and at a lower production rate than the nominal production rate by employing a liquid oxygen storage tank and, in addition, an oxygen-enriched liquid storage tank operating in conjunction with the higher pressure column sump.

7 Claims, 1 Drawing Sheet

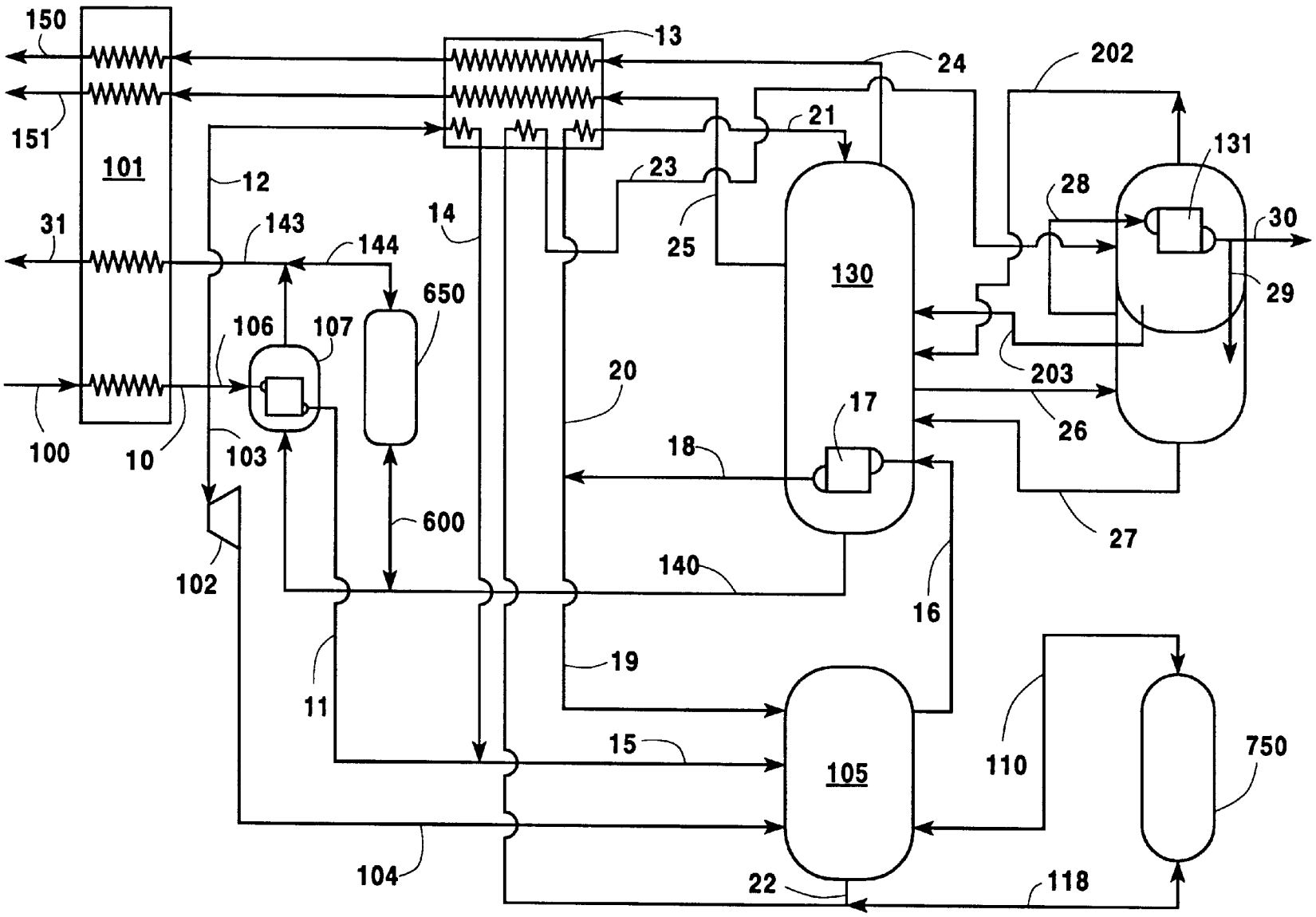
30
29
131
202
28
203
26
27
750
118
110
24
16
130
17
105
21
22
25
18
140
13
23
20
19
15
14
650
600
144
107
11
104
143
106
103
12
102
10
101
150
151
31
100

CRYOGENIC RECTIFICATION SYSTEM FOR PRODUCING OXYGEN PRODUCT AT A NON-CONSTANT RATE

TECHNICAL FIELD

This invention relates generally to cryogenic rectification and, more particularly, to cryogenic rectification to produce oxygen at a non-constant production rate.

BACKGROUND ART

During the course of operation of a cryogenic rectification plant producing oxygen, the demand for the oxygen product may change. This change in oxygen product demand requires a corresponding change in the production of oxygen product. Without such a change the system would operate inefficiently. Moreover, the faster the system changes to accommodate the change in demand, the better will be the overall performance of the system.

Accordingly, it is an object of this invention to provide a cryogenic rectification system for producing oxygen whose operation can change quickly to match the delivery of oxygen product to a change, i.e. an increase or decrease, in the demand of the oxygen product from the system.

SUMMARY OF THE INVENTION

The above and other objects, which will become apparent to those skilled in the art upon a reading of this disclosure, are attained by the present invention, one aspect of which is:

Apparatus for producing oxygen by cryogenic rectification at a non-constant production rate comprising:

(A) a double column system comprising a higher pressure column and a lower pressure column;

(B) an oxygen-enriched liquid storage tank, means for passing fluid from the oxygen-enriched liquid storage tank to the lower pressure column, and means for passing fluid from the lower portion of the higher pressure column into the oxygen-enriched liquid storage tank;

(C) a product boiler, means for passing feed air to the product boiler, and means for passing feed air from the product boiler to the higher pressure column;

(D) a liquid oxygen storage tank and means for passing fluid from the liquid oxygen storage tank to the product boiler;

(E) means for passing fluid from the lower portion of the lower pressure column to the liquid oxygen storage tank, and means for passing fluid from the lower portion of the lower pressure column to the product boiler; and (F) means for recovering fluid from the product boiler as product oxygen.

Another aspect of the invention is:

Process for producing oxygen by cryogenic rectification comprising:

(A) at least partially condensing a flow of feed air, passing the resulting feed air into the higher pressure column of a double column comprising a higher pressure column and a lower pressure column, and separating the feed air by cryogenic rectification within the higher pressure column into nitrogen-enriched vapor and oxygen-enriched liquid;

(B) passing nitrogen-enriched fluid and oxygen-enriched fluid from the higher pressure column into the lower pressure column, and separating the fluids passed into the lower pressure column by cryogenic rectification into nitrogen vapor and oxygen liquid;

(C) passing oxygen liquid from the lower portion of the lower pressure column in indirect heat exchange with the said at least partially condensing feed air to produce oxygen vapor;

(D) recovering the oxygen vapor as product oxygen, the improvement enabling product oxygen recovery at a non-constant rate comprising:

(E) increasing the production rate of product oxygen during a portion of the process by passing additional oxygen liquid from a liquid oxygen storage tank in indirect heat exchange with the at least partially condensing feed air and increasing the flow of the at least partially condensing feed air, and passing oxygen-enriched liquid from the higher pressure column into an oxygen-enriched liquid storage tank; and (F) decreasing the production rate of product oxygen during another portion of the process by passing oxygen liquid from the lower portion of the lower pressure column into the liquid oxygen storage tank and decreasing the flow of the at least partially condensing feed air, and passing oxygen-enriched liquid from the oxygen-enriched liquid storage tank into the lower pressure column.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation or fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process*. The term double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s)in the liquid phase. Rectification, or continuous distillation, is the separation process that combines successive partial vaporizations and condensations as obtained by a countercurrent treatment of the vapor and liquid phases. The countercurrent contacting of the vapor and liquid phases may be adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "argon column" means a column which processes a feed comprising argon and produces a product having an argon concentration which exceeds that of the feed.

As used herein the term "sump" means the bottom portion of a distillation column below the trays or packing elements in which liquid is accumulated.

As used herein the term "level controller" means a mechanical, pneumatic or electronic device or a mathematical algorithm programmed in a computer used for feedback control of the liquid level within a storage volume such as a tank or a column sump.

As used herein, the term "feed air" means a mixture comprising primarily nitrogen, oxygen and argon, such as ambient air.

As used herein, the term "product oxygen" means a fluid having an oxygen concentration within the range of from 90 to 99.99 mole percent.

As used herein, the terms "upper portion" and "lower portion" means those sections of a column respectively above and below the mid point of the column.

As used herein, the term "product boiler" means a heat exchanger wherein feed air is at least partially condensed by indirect heat exchange with vaporizing liquid oxygen. The product boiler may be a separate or stand alone heat exchanger or may be incorporated into a larger heat exchanger.

BRIEF DESCRIPTION OF THE DRAWING

The sole FIGURE is a schematic representation of one preferred embodiment of the cryogenic oxygen production system of this invention wherein an argon column is additionally employed.

DETAILED DESCRIPTION

The invention will be described in greater detail with reference to the Drawing. The invention will be first described in conjunction with steady state operation and then with changes in the oxygen product demand which require an increase or decrease in the product oxygen production rate.

Referring now to the FIGURE, feed air 100, which has been cleaned of high boiling impurities such as water vapor, carbon dioxide and hydrocarbons, and which has been compressed to a pressure generally within the range of from 100 to 700 pounds per square inch absolute (psia), preferably 100 to 200 psia, is cooled by passage through primary heat exchanger 101 by indirect heat exchange with return streams. Resulting cooled, cleaned, compressed feed air 10 is divided into three portions. A first portion 106 of the feed air is passed into product boiler 107 wherein it is at least partially condensed by indirect heat exchange with boiling liquid oxygen as will be more fully described below. Resulting at least partially condensed feed air stream 11 is then passed into higher pressure column 105. Another portion 12 of the cooled, cleaned, compressed feed air is further cooled and condensed by partial traverse of heat exchanger 13 by indirect heat exchange with return streams and resulting feed air stream 14 is passed into higher pressure column 105. In the embodiment of the invention illustrated in the FIGURE, feed air streams 11 and 14 are combined to form feed air stream 15 for passage into higher pressure column 105. Another portion 103 of the cooled, cleaned, compressed feed air is turboexpanded by passage through turboexpander 102 to generate refrigeration and resulting turboexpanded feed air stream 104 is passed into higher pressure column 105.

High pressure column 105 is part of a double column system which also comprises lower pressure column 130. Higher pressure column 105 is operating at a pressure generally within the range of from 70 to 100 psia. Within higher pressure column 105 the feed air is separated by cryogenic rectification into nitrogen-enriched vapor and oxygen-enriched liquid. Nitrogen-enriched vapor is withdrawn from the upper portion of first or higher pressure column 105 in stream 16 and passed into main condenser 17 wherein it is condensed by indirect heat exchange with boiling lower pressure column bottom liquid. Resulting nitrogen-enriched liquid 18 is divided into a first portion 19 which is passed back into higher pressure column 105 as reflux liquid, and into a second portion 20 which is subcooled by partial traverse of heat exchanger 13 against return streams and then passed as stream 21 into the upper portion of lower pressure 130 as reflux liquid.

Oxygen-enriched liquid has an oxygen concentration generally within the range of from 25 to 45 mole percent. Oxygen-enriched liquid is withdrawn from the lower portion of higher pressure column 105 in stream 22, and subcooled by partial traverse of heat exchanger 13 against return streams prior to being passed into lower pressure column 130. The embodiment of the invention illustrated in the FIGURE is a preferred embodiment wherein an argon column with a top condenser is also employed and wherein some or all of the subcooled oxygen-enriched liquid is first processed in the argon column top condenser prior to being passed into the lower pressure column. Referring back to the FIGURE, subcooled oxygen-enriched liquid 23 is passed into argon column top condenser 131, wherein it is at least partially vaporized by indirect heat exchange with argon column top vapor. Resulting oxygen-enriched vapor and any remaining oxygen-enriched liquid are passed in streams 202 and 203 respectively from top condenser 131 into lower pressure column 130.

Second or lower pressure column 130 is operating at a pressure less than that of higher pressure 105 and generally within the range of from 15 to 30 psia. Within lower pressure column 130 the fluids passed into that column are separated by cryogenic rectification into nitrogen vapor and oxygen liquid. Nitrogen vapor is withdrawn from the upper portion of lower pressure column 130 in stream 24, warmed by passage through heat exchangers 13 and 101 and recovered, in whole or in part, as nitrogen product stream 150 having a nitrogen concentration generally within the range of from 99 to 99.999 mole percent. For product purity control purposes a waste steam 25 is withdrawn from the upper portion of lower pressure column 130 below the withdrawal point of stream 24, warmed by passage through heat exchangers 13 and 101, and removed from the system as stream 151.

A stream comprising primarily argon and oxygen is withdrawn from the lower portion of lower pressure column 130 in stream 26 and passed into argon column 120 wherein it is separated by cryogenic rectification into argon-richer fluid and oxygen-richer fluid. The oxygen-richer fluid is passed from argon column 120 as liquid stream 27 back into lower pressure column 130. Argon-richer fluid is passed as argon column top vapor into top condenser 131 in stream 28 wherein it is at least partially condensed by indirect heat exchange with the aforesaid at least partially vaporizing oxygen-enriched liquid. A portion 29 of the resulting argon-richer fluid is employed as reflux for column 120 and another portion 30 is recovered as product crude argon having an argon concentration generally within the range of from 95 to 99.999 mole percent.

Oxygen liquid is withdrawn from the sump of lower pressure column 130 in stream 140 and passed into product boiler 107 wherein it is vaporized by indirect heat exchange with the aforesaid at least partially condensing feed air. Optionally, the liquid stream 140 may be pumped (not shown) to a higher pressure prior to passage to produce boiler 107. Resulting oxygen vapor is passed in stream 143 from product boiler 107 through main heat exchanger 101 wherein it is warmed and from which it is recovered as product oxygen in stream 31.

The invention enables the production rate of product oxygen in stream 31 to change quickly and without imposing an operating inefficiency on the system. The invention achieves these results by employing a liquid oxygen storage tank 650 and an oxygen-enriched liquid storage tank 750.

During a portion of the production process when it is desired that the production rate of product oxygen be increased so that it is higher than the nominal production rate of product oxygen for the system, the flow of feed air 106 into product boiler 107 is increased and liquid oxygen from liquid oxygen storage tank 650 is passed in conduit 600 into stream 140 for passage into product boiler 107 for additional production of product oxygen. The gas phase pressure of liquid oxygen storage tank 650 is maintained by the conduit 144 between product boiler 107 and liquid oxygen storage tank 650. Oxygen-enriched liquid is passed from the sump of higher pressure column 105 in conduit 118 into oxygen-enriched liquid storage tank 750. Storage tank 750 is physically located at the same elevation as the liquid sump of higher pressure column 105. The level of the oxygen-enriched liquid in the sump of higher pressure column 105 and oxygen-enriched liquid storage tank 750 is controlled by a level controller which controls the liquid level in the sump of column 105.

During a portion of the production process when it is desired that the production rate of product oxygen be decreased so that it is lower than the nominal production rate of product oxygen for the system, the flow of feed air 106 into product boiler 107 is decreased and a portion of the liquid oxygen from the sump of lower pressure column 130, which would otherwise have been passed to product boiler 107, is passed instead through conduit 600 into liquid oxygen storage tank 650. Oxygen-enriched liquid is passed from oxygen-enriched liquid storage tank 750 either into the sump of higher pressure column 105 for passage into the lower pressure column or, as illustrated in the FIGURE, through conduit 118 for flow into stream 22 and then into lower pressure column 130 as was previously described. Oxygen-enriched liquid and oxygen-enriched vapor in equilibrium with the oxygen-enriched liquid preferably are allowed to flow freely between the sump of column 105 and tank 750 by use of conduits 118 and 110 respectively. Preferably when the process is operated in either the increased or decreased product oxygen production rate modes, the flow ratio between the flow of oxygen-enriched liquid flowing in conduit 118 and the flow of liquid oxygen flowing in conduit 600 is within the range of from 1.10 to 1.15 on a molal basis.

Although the invention has been described in detail with reference to a certain particularly preferred embodiment, those skilled in the art will recognize that there are other embodiments of the invention within the spirit and the scope of the claims.

What is claimed is:

1. Apparatus for producing oxygen by cryogenic rectification at a non-constant production rate comprising:

(A) a double column system comprising a higher pressure column and a lower pressure column and means for passing fluid from the lower portion of the higher pressure column to the lower pressure column;

(B) an oxygen-enriched liquid storage tank, means for passing fluid from the oxygen-enriched liquid storage tank to the higher pressure column, and means for passing fluid from the lower portion of the higher pressure column into the oxygen-enriched liquid storage tank;

(C) a product boiler, means for passing feed air to the product boiler, and means for passing feed air from the product boiler to the higher pressure column;

(D) a liquid oxygen storage tank and means for passing fluid from the liquid oxygen storage tank to the product boiler;

(E) means for passing fluid from the lower portion of the lower pressure column to the liquid oxygen storage tank, and means for passing fluid from the lower portion of the lower pressure column to the product boiler; and (F) means for recovering fluid from the product boiler as product oxygen.

2. The apparatus of claim 1 further comprising an argon column having a top condenser wherein the means for passing fluid from the lower portion of the higher pressure column to the lower pressure column includes the top condenser.

3. Process for producing oxygen by cryogenic rectification comprising:

(A) at least partially condensing a flow of feed air, passing the resulting feed air into the higher pressure column of a double column comprising a higher pressure column and a lower pressure column, and separating the feed air by cryogenic rectification within the higher pressure column into nitrogen-enriched vapor and oxygen-enriched liquid;

(B) passing nitrogen-enriched fluid and oxygen-enriched fluid from the higher pressure column into the lower pressure column, and separating the fluids passed into the lower pressure column by cryogenic rectification into nitrogen vapor and oxygen liquid;

(C) passing oxygen liquid from the lower portion of the pressure column in indirect heat exchange with the said at least partially condensing feed air to produce oxygen vapor;

(D) recovering the oxygen vapor as product oxygen, the improvement enabling product oxygen recovery at a non-constant rate comprising:

(E) increasing the production rate of product oxygen during a portion of the process by passing additional oxygen liquid from a liquid oxygen storage tank in indirect heat exchange with the at least partially condensing feed air and increasing the flow of the at least partially condensing feed air, and passing oxygen-enriched liquid from the higher pressure column into an oxygen-enriched liquid storage tank; and (F) decreasing the production rate of product oxygen during another portion of the process by passing oxygen liquid from the lower portion of the lower pressure column into the liquid oxygen storage tank and decreasing the flow of the at least partially condensing feed air, and passing oxygen-enriched liquid from the oxygen-enriched liquid storage tank into the higher pressure column.

4. The process of claim 3 wherein the oxygen-enriched fluid from the higher pressure column is subcooled prior to being passed into the lower pressure column.

5. The process of claim 3 wherein the oxygen-enriched fluid from the higher pressure column is at least partially vaporized prior to being passed into the lower pressure column.

6. The process of claim 3 wherein during the portion of the process recited in clause (E), the ratio of the flow of the oxygen-enriched liquid passing from the higher pressure column into the oxygen-enriched liquid storage tank to the flow of the oxygen liquid passing from the liquid oxygen storage tank in indirect heat exchange with the at least partially condensing feed air is within the range of from 1.10 to 1.15 on a molal basis.

7. The process of claim 3 wherein during the portion of the process recited in clause (F), the ratio of the flow of the oxygen-enriched liquid passing from the oxygen-enriched liquid storage tank to the higher pressure column to the flow of oxygen passing from the lower portion of the lower pressure column into the liquid oxygen storage tank is within the range of from 1.10 to 1.15 on a molal basis.

* * * * *